US005743238A

United States Patent [19]

Shorey et al.

[11] Patent Number: 5,743,238

[45] Date of Patent: *Apr. 28, 1998

[54] FUEL PUMPING AND INJECTION SYSTEMS

[75] Inventors: Stacy Jean Shorey, Grand Rapids; Randall Clare Harkema, Caledonia; Beckie J. DeYoung, Stanwood; Kenneth R. Potter, Kalamazoo; Robert Daniel Straub, Lowell, all of Mich.

[73] Assignee: Diesel Technology Company, Wyoming, Mich.

[ * ] Notice: The term of this patent shall not extend beyond the expiration date of Pat. No. 5,636,615.

[21] Appl. No.: 824,373

[22] Filed: Mar. 25, 1997

Related U.S. Application Data

[63] Continuation of Ser. No. 543,306, Oct. 16, 1995, Pat. No. 5,636,615, which is a continuation-in-part of Ser. No. 393, 127, Feb. 21, 1995, abandoned.

[51] Int. Cl.[6] ..... F02M 37/04

[52] U.S. Cl. ..... 123/506; 123/458; 251/129.16

[58] Field of Search ..... 123/506, 458, 123/446, 447, 500, 501, 502; 251/129.16

[56] References Cited

U.S. PATENT DOCUMENTS

| | | | |
|---|---|---|---|
| 2,358,828 | 9/1944 | Ray | 123/458 |
| 2,911,183 | 11/1959 | Mathews | 123/458 |
| 4,618,095 | 10/1986 | Spoolstra | 123/458 |
| 4,653,455 | 3/1987 | Edlen | 123/506 |
| 4,653,723 | 3/1987 | Rizk | 123/506 |
| 5,058,553 | 10/1991 | Rondo | 123/506 |
| 5,096,121 | 3/1992 | Grinsteiner | 123/506 |
| 5,191,867 | 3/1993 | Giassey | 123/506 |
| 5,265,804 | 11/1993 | Brunel | 123/506 |
| 5,357,933 | 10/1994 | Kasahara | 123/506 |
| 5,636,615 | 6/1997 | Shorey | 123/506 |

*Primary Examiner*—Carl S. Miller
*Attorney, Agent, or Firm*—Brooks & Kushman PC

[57] ABSTRACT

A device is provided for pumping fuel through an internal combustion engine, comprising a pump cylinder and a piston reciprocable within the pump cylinder to define a pump chamber open at one end in which fuel is pressurized during a pump stroke of the piston. A fuel supply means is provided for supplying fuel to the pump chamber. The fuel supply means includes an electromagnetically actuated fuel control valve having an armature secured thereto, with the armature residing in a fuel-filled armature cavity. The armature electromagnetically cycled between a first position closing the fuel control valve and thereby closing the flow of fuel to the pumping chamber and a second position opening the control valve thereby allowing fuel to flow to the pumping chamber. The armature is a flat plate secured to the control valve and constructed with a series of flow through holes and/or slots of prescribed geometry to (i) assist in precluding cavitation errosion of the armature and/or fastener securing it to the control valve by the fuel within the armature cavity, and (ii) to enhance the hysteresis characteristics of the fuel control valve. Various embodiments are provided.

13 Claims, 5 Drawing Sheets

FUEL PUMPING AND INJECTION SYSTEMS

This is a continuation of application Ser. No. 08/543,306 filed on Oct. 16, 1995, U.S. Pat. No. 5,636,615, which is a continuation-in-part of application Ser. No. 08/393,127 filed on Feb. 21, 1995, abandoned.

TECHNICAL FIELD

This invention relates to solenoid actuated fuel pumping and injection systems, and in particular, to unit pump and unit injectors for diesel fueled engines.

BACKGROUND OF THE INVENTION

Solenoid actuated unit injectors for controlling the admission of fuel to diesel engines, particularly heavy duty trucks and marine engines, have been in common use for a number of years. Early on, the fuel control valve for admitting fuel to the pressure chamber of these devices was mechanically actuated. In more recent years, the solenoid actuated control valve has become more popular and useful in light of its quick action and the fact that it can be easily and accurately programmed with current electronically controlled engines and software systems. An example of such a unit injector is shown in U.S. Pat. Nos. 4,392,612, 4,618,095, and 4,741,478 assigned to the assignee of the present invention.

The concept of substituting for the solenoid actuated unit injector, a system comprising a solenoid actuated unit pump in fluid communication with a respective injector nozzle, as a separate device, is also becoming popular. An example of such a system is shown in U.S. Pat. No. 3,779,225.

It will be noted in either case, i.e. with the solenoid actuated unit injector or the solenoid actuated unit pump, there is provided an electromagnetic coil for energizing an armature which is attached to a fuel control valve, which admits fuel to a pressure chamber (either in the pump or in the injector body depending on the device). Most commonly, the control valve with attached armature plate is spring biased to a normally open position with the electromagnetic coil being in an unenergized state. Upon energization of the electromagnetic coil, the control valve, in the form of a sliding reciprocating valve, is closed momentarily until the electromagnetic coil is next deenergized. Also most commonly, as shown in both of the above referenced patents, the chamber or cavity within which the armature resides is fuel filled to provide equalization of pressure on all sides of the reciprocating fuel control valve and to allow a certain degree of damping on the action of the armature plate as the electromagnetic coil is repeatedly energized and deenergized. This also helps control valve bounce which refers to the action of the control valve returning home on its valve seat as the valve is closed.

In both of the above-referenced systems, it is common to secure the armature plate to the control valve by means of a flathead countersunk screw in such a manner that the screw head faces the surface of the armature that is exposed to the electromagnetic coil and the screw shank is embedded within the control valve.

Prior to the present invention, this flatheaded countersunk screw has included a recessed socket head so that it can be screwed home into the control valve by means of a socket wrench having an Allenhead, or hexagonal fluted configuration.

Most recently, due to operating demands being made of the solenoid for more finite control of fuel emissions, including such things as pilot injection which requires increasing the frequency of reciprocation of the control valve, it has been noted that the socket pocket in the armature fastener is a source of cavitation erosion. This is believed to be caused by the changing state of the fuel from a fluid to a gaseous state, and resultant gas bubbles being compressed and, in effect, exploding in the recess of the cavity thereby releasing energy and causing erosion.

As a complement to the elimination of the armature plate and fastener as a source of cavitation erosion, the present invention is directed towards improving the strength of the magnetic field across the armature plate, and thus the hysteresis characteristics of the armature and fuel control valve of which it is a part.

The present invention is directed toward eliminating the armature plate and fastener as a source of cavitation erosion, and in facilitating the assembly of the armature plate to the control valve.

SUMMARY OF THE INVENTION

The present invention contemplates a device for pumping fuel to an internal combustion engine, comprising a pump cylinder and a piston reciprocable within said pump cylinder to define a pump chamber open at one end in which fuel is pressurized during a pump stroke of the piston. A fuel supply means is provided for supplying fuel to said pump chamber The fuel supply means includes an electromagnetically activated fuel control valve having an armature secured thereto, with armature residing in a fuel filled armature cavity, and being electromagnetically cycled from a first position closing the fuel control valve and thereby closing the flow of fuel to the pumping chamber and a second position opening the control valve thereby allowing fuel to flow to the pumping chamber. The armature is a flat plate secured to the control valve by means of a flatheaded countersunk screw, the head of which resides within the armature plate surface exposed to an electromagnetic stator and the threaded shank portion of which is secured within the control valve. The plane of the flatheaded screw is substantially on the same plane as the armature plate. The screw and the armature plate in combination provide means for precluding cavitation erosion of the screw head by the fuel within the armature cavity.

The invention further contemplates a device of the type described above, wherein the armature plate includes a series of through holes of predetermined size and spaced relation relative to one another to provide a fuel flow through passage, collectively speaking, sufficient to substantially reduce or eliminate cavitation erosion, and yet of a size and geometry which will not adversely affect the strength of the magnetic field across the armature plate.

The invention also contemplates a device of the type described above, wherein the flow through holes in the armature plate are constructed as narrow slots extending from the center of the armature plate in proximity to the screw counterbore to the edges of the armature plate, and wherein the slots may be directed either radially or longitudinally across the armature plate.

The object and features of the present invention will become more readily apparent from the following detailed description of the preferred embodiments taken in conjunction with the accompanying drawings.

DESCRIPTION OF THE PREFERRED EMBODIMENTS

Figure 1:
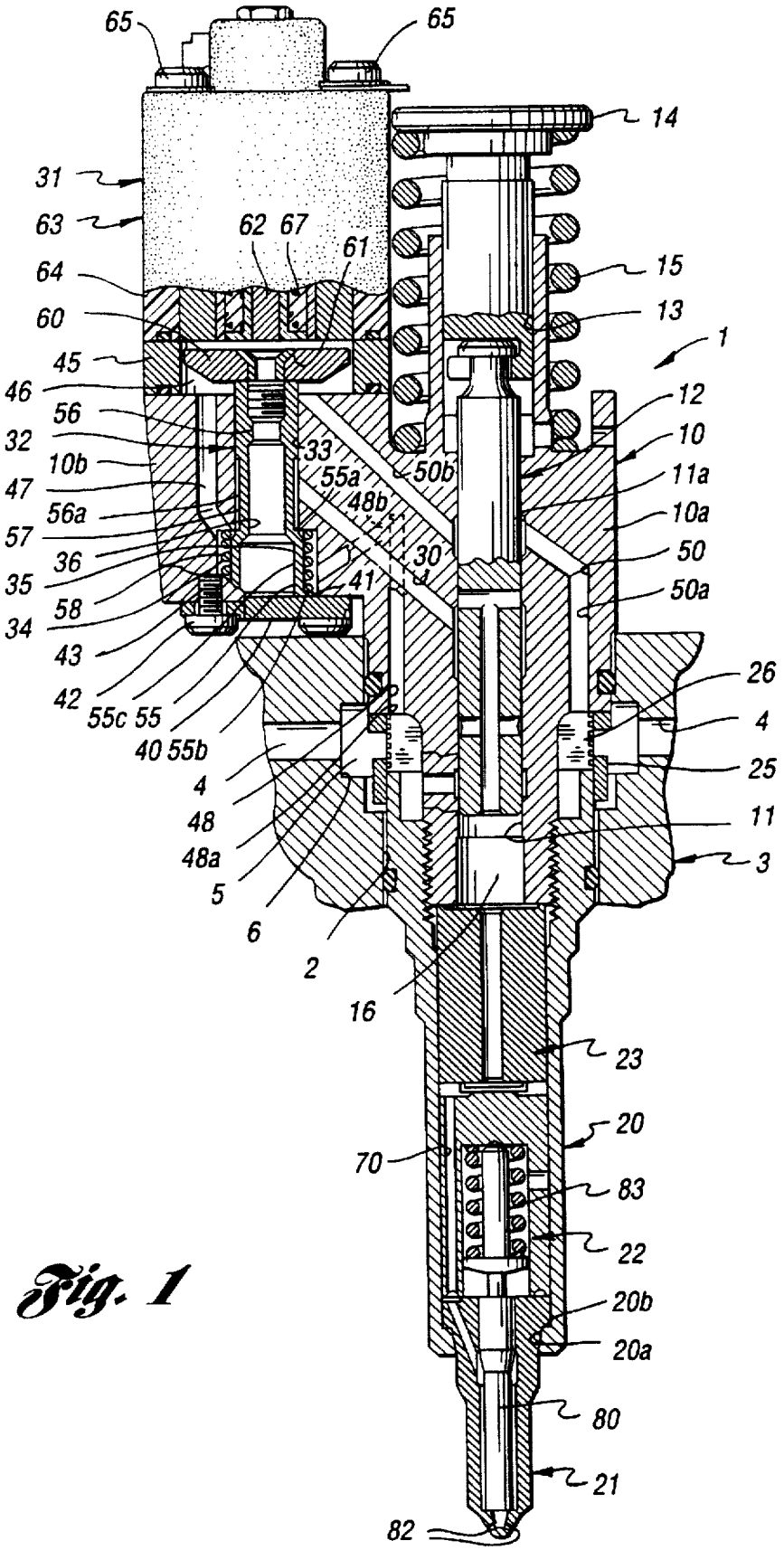
FIG. 1 is a longitudinal sectional view of an electromagnetic unit fuel injector of a type in which the present invention may be incorporated with elements of the injector being shown so that the fuel control valve is shown in a normally open position.

Referring first to FIG. 1, there is shown an electromagnetic unit fuel injector known in the prior art, as shown in U.S. Pat. No. 4,618,095, assigned no the assignee of the subject invention, the teachings of which are incorporated herein by reference, and which is shown here for the purpose of describing the general environment in which the uniquely constructed armature and fuel control valve are secured together in accordance with the present invention.

This same subassembly in accordance with the present invention is applicable to the design and construction of unit fuel pumps, such as shown in U.S. Pat. No. 3,779,225, the teachings of which are also incorporated herein by reference.

An electromagnetic unit injector, generally designated 1, is adapted to be mounted in a suitable bore or injector socket 2 provided for this purpose in the cylinder head 3 of a diesel engine so that the lower spray tip end of the injector projects from the cylinder head 3 for the discharge of fuel into the associate combustion chamber, not shown.

The electromagnetic unit fuel injector 1 is, in effect, a unit fuel injector-pump assembly with an electromagnetic actuated, normally open control valve incorporated therein to control fuel discharge from the injector portion of this assembly in a manner to be described.

In the construction illustrated, the electromagnetic unit fuel injector 1 includes an injector body 10 which is defined by a vertical main body portion 10*a* and an integral side body portion 10*b*. The body portion 10*a* is provided with a vertical extending stepped bore therethrough to provide a lower cylindrical wall defining a cylinder or bushing 11 of an internal diameter to slidably and sealingly receive a pump plunger 12 and an upper wall 13 of a larger internal diameter than that defining the bushing. An actuator follower 14 is operatively connected to the upper outboard portion of the plunger 12, whereby it and the plunger thus operatively connected thereto are adapted to be reciprocated, for example by an engine driven camshaft 7, push rod 8 and rocker arm 9, in a known manner as schematically shown, for example, in FIG. 3. A plunger return spring 15 is operatively connected to the plunger 12 to normally bias it in a suction stroke direction.

The pump plunger 12 forms with the bushing 11 a variable volume pump chamber 16 at the lower open end of the bushing 11.

In a conventional manner, a nut 20 is threaded to the lower end of the body 10 to form an extension thereof. Nut 20 has an opening 20*a* at its lower end through which extends the lower end of a combined injector valve body or spray tip 21, hereinafter referred to as the spray tip, of a conventional fuel injection nozzle assembly. Between the spray tip 21 and the lower end of the injector body 10 there is positioned, in sequence starting from the spray tip, a spring cage 22, and a director cage 23, these elements being formed, in the construction illustrated, as separate elements for ease of manufacturing and assembly.

As well known, the threaded connection of the nut 20 to body 10 holds the spray tip 21, spring cage 22, and director cage 23 clamped and stacked end-to-end between the shoulder 20*b* of the nut 20 and the bottom face of body portion 10*a*. All of these above-described elements have lapped mating surfaces whereby they are held in pressure sealed relation to each other.

The cylinder head 3 is provided with a single flow through fuel passage 4 which serves as both a fuel supply passage and a drain passage to and from the injector 1, this fuel passage 4 being located so as to be in flow communication with an annular shaped cavity 5 defined by a stepped annular groove 6 provided for this purpose in the socket 2 of the cylinder head 3.

The basic flow of fuel to the pump chamber 16 and drain flow therefrom is by means of a supply/drain passage means 30 having the flow therethrough controlled by a solenoid, generally designated 31, actuated control valve 32.

For this purpose, the side body portion 10*b* is provided with a stepped bore therethrough to define circular internal walls including an upper valve stem guide wall 33 of predetermined internal diameter and a lower wall 34 of substantially larger internal diameter than that of guide wall 33, these walls being interconnected by a flat shoulder 35 that terminates with a small inclined wall defining an annular, conical valve seat 36 encircling guide wall 33.

In the construction illustrated, a closure cap 40 with a central upstanding boss 41 is suitable secured, as by screws 42, to the lower surface of the side body portion 10*b* so as to be concentric with lower wall 34 whereby to define with this wall 34 and shoulder 35 a supply-drain chamber 43. As shown, the boss 41 is of a predetermined height, as desired, to serve as a central valve 32 opening stop. In addition, a hollow solenoid spacer 45, sealingly and suitably secured in sandwiched relationship between the lower surface of the solenoid 31 and the flat upper surface of the side body portion 10*b* in substantially encircling relationship to the valve stem guide wall 33 defines an armature cavity 46 that is in direct flow communication with the supply/drain chamber 43 by a pressure equalizing passage 47 that is radially offset relative to the axis of the bore defined by the bore forming the valve stem guide wall 33.

Fuel is supplied to the supply/drain chamber 43 and drained therefrom by means of a primary supply/drain passage 48 that includes a vertical passage portion 48*a* in the main body portion 10*a* which at one end is in flow communication with supply/drain cavity 26 and which at its opposite end communicates with the upper end of an inclined passage portion 48*b*, the lower end of which opens through wall 34 into the supply/drain chamber 43. In addition, fuel can be supplied to the armature chamber 46 and drained therefrom by means of a secondary supply/drain passage 50 which includes a first passage portion 50*a*, which at one end is in flow communication with an annular groove 11*a* in bushing 11, and an inclined second passage portion 50*b* extending from the annular groove 11*a* to open through the upper surface of the side body portion 10*b* into the armature chamber 46.

Flow between the supply/drain chamber 43 and passage 30 is controlled by the solenoid 31 actuated control valve 32.

The control valve 32, in the form of a hollow popper valve, includes an axially elongated head 55 having a conical valve seat surface 55*a* at one end thereof, the upper end with reference to FIG. 1, a spring engaging, outward extending, radial flange 55*b* at its opposite or lower end and at least one radial passage 55*c* through the wall of the head intermediate these ends and a stem 56 extending upward therefrom. The stem 56 includes an upper portion of a diameter to be reciprocally received in the valve stem guide wall 33 and a lower portion 56*a* of reduced diameter next adjacent to the valve seat surface 55*a* of head 55 having an axial extent so as to form with the valve stem guide wall 33 an annulus cavity 57 that is in communication with passage 30 during opening and closing movement of the control valve 32.

Control valve 32 is normally biased to an open position relative to the valve seat 36, the position shown in FIG. 1, by means of a spring 58, of predetermined force, that loosely encircles the main body portion of the valve head 55 and that has one end thereof in abutment against the radial flange 55*b* of the valve head. Movement of the control valve 32 to a valve closed position against the valve seat 36 by means of a solenoid 31 actuated flat armature 60 that is loosely received in the armature cavity 56 and which is suitably secured to the upper valve stem 56 end of the control valve 32, as by means of a hollow screw 61 threadingly engaged in the internally threaded upper free end of the valve stem 56.

As seen in FIG. 1, the armature 60 is thus loosely received in the complementary shaped armature cavity 56 provided in the solenoid spacer 45 for movement relative to an associate pole piece 62 of the solenoid assembly 31.

The solenoid assembly 31 further includes a stator assembly, generally designated 63, having a flanged inverted cup-shaped solenoid case 64, made for example, of a suitable plastic such as glass filled nylon, which is secured as by screws 65 to the upper surface of the side body portion 10*b*, with the solenoid spacer 45 sandwiched therebetween, in position to encircle the valve stem guide wall 33.

The solenoid coil 67 is adapted to be connected to a suitable source of electrical power via a fuel injection electronic control circuit, not shown, whereby the solenoid coil can be energized as a function of the operating conditions of an associated engine in a manner well known in the art.

Thus during engine operation, fuel is supplied at a predetermined supply pressure by a pump, not shown, to the injector i via the fuel passage 4 and cavity 5 in cylinder head 3 and through the filter 25 into the supply/drain cavity 26. Fuel thus supplied to the supply/drain cavity 26 can flow through passage 48 into the supply/drain chamber 43 and from this chamber 43 it can flow via the pressure equalizing passage 47 and also through the ports 55*c* and hollow control valve 32 and screw 61 into the armature cavity 46. In the construction shown in FIG. 1, fuel can also flow in either direction between the armature cavity 46 and the supply/drain cavity 26 via the drain passage 50.

with the solenoid coil 67 of solenoid 31 deenergized, the valve spring 58 will be operative to open and hold open the control valve 32 relative to the valve seat 36 and, of course, the armature 60 is thus positioned with a predetermined working air gap between its working surface and the opposed working surface of the pole piece 62.

Thus during a suction stroke of the plunger 12, with the control valve 32 then in its open position, fuel can now flow from the supply/drain chamber 43 through the annulus passage now defined between the valve seat surface 55*a* and valve seat 36 into the pump chamber 16.

Thereafter, during the pump stroke of the plunger 12, this downward pump stroke movement of the plunger will cause pressurization of the fuel within the pump chamber 16 and of course of the fuel in the passages 30 and the discharge passage means 70 associated therewith. However, with the solenoid coil 67 still deenergized, this pressure can only rise to a level that is a predetermined amount less than the "pop" pressure required to lift the needle valve 80 against the force of its associate return spring 83.

During this period of time, the fuel displaced from the pump chamber 16 can flow via the passage 30 and the cavity 57 back to the supply/drain chamber 43 since the control valve 32 is still open.

Thereafter, during the continued downward stroke of the plunger 12, an electrical (current) pulse of finite character and duration (time relative to example to the top dead center of the associate engine piston, not shown, position with respect to the camshaft and rocker arm linkage) applied through suitable electrical conductors to the solenoid coil 67 produces an electromagnetic field attracting the armature 60 upward, from the position shown in FIG. 1, toward the pole piece 62.

This movement of the armature 60 as coupled will effect seating of the control valve 32 against its associate valve seat 36. As this occurs, the drainage of fuel from the pump chamber 16 via passage 30 in the manner described hereinabove will no longer occur. Without this spill of fuel from the pump chamber 16, the continued downward movement of the plunger 12 will increase the pressure of fuel therein to a "pop" pressure level to effect unseating of the needle valve 80. This then permits the injection of fuel out through the spray orifices 82. Normally, the injection pressure continues to build up during further continued downward movement of the plunger 12.

Ending the application of electrical current pulse to the solenoid coil 67 causes the electromagnetic field to collapse. As this occurs, the force of the valve spring 58 causes immediate unseating of the control valve 32 so as to allow spill fuel flow from the pump chamber 16 via the passages including passage 30 back to the supply/drain chamber 43. This spill flow of fuel thus releases the injection nozzle system pressure as in the discharge passage means 70 so that the spring 83 can again effect seating of the injection valve 80.

Figure 2:
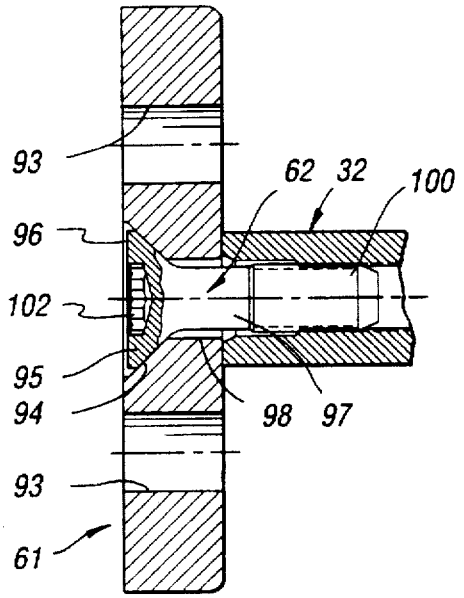
FIG. 2 is an enlarged cross-sectional view of the fuel filled armature cavity portion of the injector of FIG. 1, showing a conventional armature plate and fuel control valve securement structure.

FIG. 2 illustrates what is already part of the prior art as represented in FIG. 1. An armature plate 61 generally rectangular in shape and having a pair of diametrically opposed fuel equalization flow through ports 93 is secured to the hollow fuel control valve 32 by means of a screw The screw is countersunk as shown at 64 within the armature plate 61. It has a flat head 95 having a top surface 96 designed to be positioned right at or slightly below the surface of the armature plate. The screw further includes an unthreaded shank portion 97 in clearance relationship with the screw bore 98 through the armature plate. The screw further contains a threaded shank portion 100 at the end opposite the head which is taken up in the internal threads of the fuel control valve 32. For driving the screw home within the fuel control valve, the head portion is recessed to include an Allenhead type socket 102. The fuel control valve is held in place as the screw is turned home to bring the armature plate in secure abutment to the control valve.

It has been found that during operation of the electromagnetic coil unit at particularly high frequencies, which is typical of the multiple phase injection routines in use today, there occurs cavitation erosion around this socket due to the pressure of the fuel, and particularly the cavitation most likely caused by the drop in pressure as the plate goes back and forth, thereby creating a constant fluctuation of the fuel from a gaseous state to a fluid state, and the energy released by the fuel within the socket as it changes from one state to the next.

Figure 3:
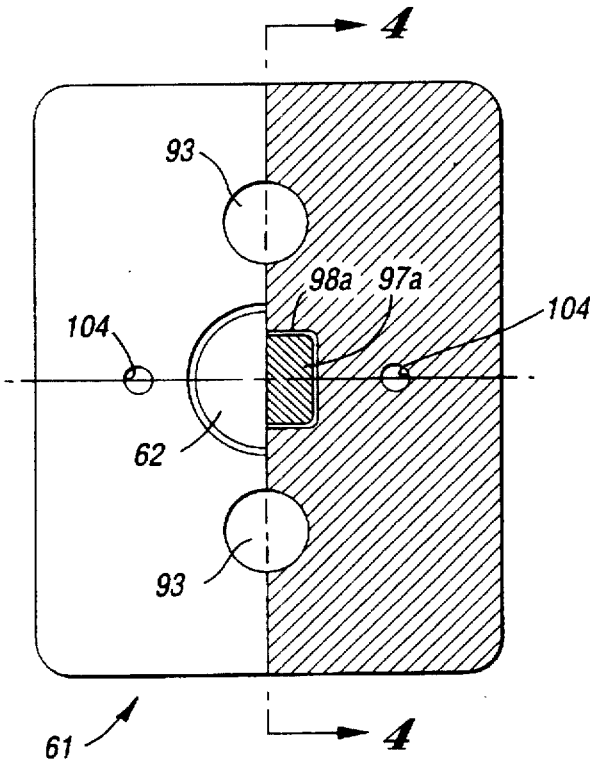
FIG. 3 is a plan view shown in partial cross-section of an armature plate and fuel control valve securement structure in accordance with one embodiment of the subject invention, with the cross-section being taken along the lines 3—3 of FIG. 4.
Figure 4:
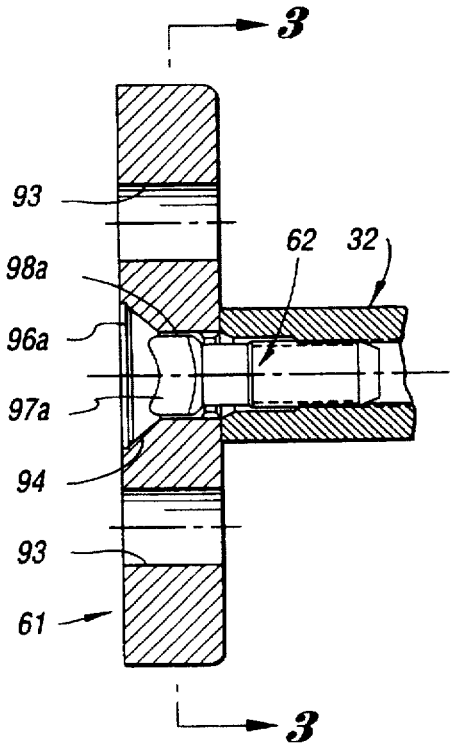
FIG. 4 is a cross-sectional view of the armature and fuel control valve securement structure as taken along the line 4—4 of FIG. 3 of FIG. 3.

FIGS. 3 and 4 show one embodiment of our invention. Except as noted below, it is identical to the disclosure of FIG. 2 and like numerals are used to designate the same element.

Armature 61 is countersunk at 94 to receive a flatheaded countersunk screw 62. The shank of the unthreaded portion 97*a* of the screw is rectangular in cross-section as is the screw bore 98*a* through the armature plate. Thus, when the screw is placed within the armature plate, it cannot rotate relative to the armature plate. The screw head is completely flat across its surface 96*a*, and fixed at a depth relative to the surface of the armature plate, in the same manner as described above regarding FIG. 2. The fuel control valve is internally threaded to receive a threaded shank portion of the screw, all as described above. Additionally, FIG. 3 shows a second pair of diametrically opposed fuel flow equalization ports 104 of smaller diameter than the first described pair of pressure equalization ports 93. In the past, it has been common to provide an armature plate with two such pair of diametrically opposed ports, as shown in FIG. 3 with the larger set of ports being at approximately 3 mm diameter in size and the smaller pair of ports being approximately 1 mm diameter in size, the drawing of FIG. 3 being shown in approximate near scale to these dimensions. Thus, the present invention as depicted in FIGS. 3 and 4 differs from the prior art as shown in FIG. 2 primarily in the construction of the screw and in providing the screw throughbore of the armature as being non-circular to match the non-circular cross-section of the unthreaded shank portion of the screw.

Figure 5:
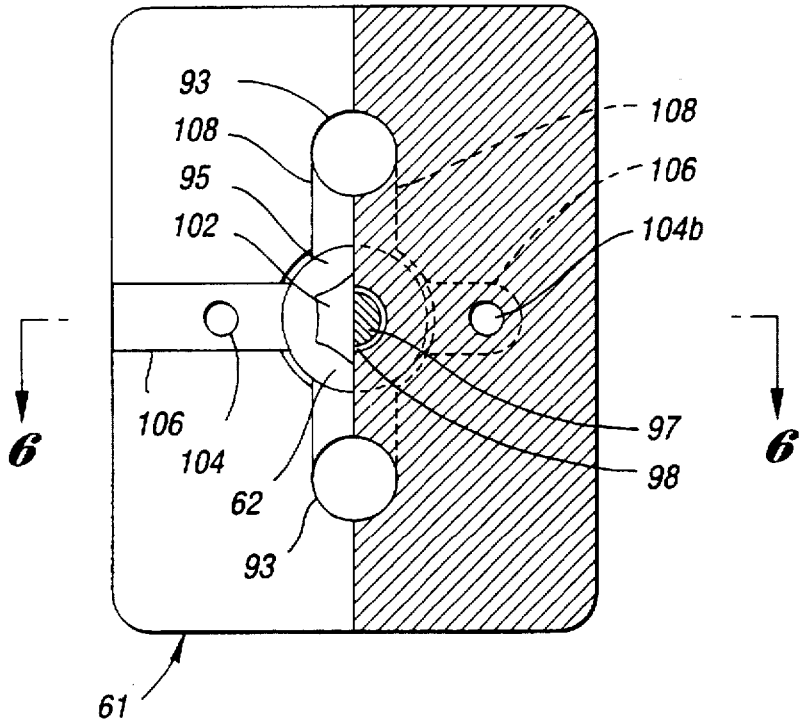
FIG. 5 is a view similar to FIG. 3 showing a second embodiment of the present invention, as taken along the line 5—5 of FIG. 6.
Figure 6:
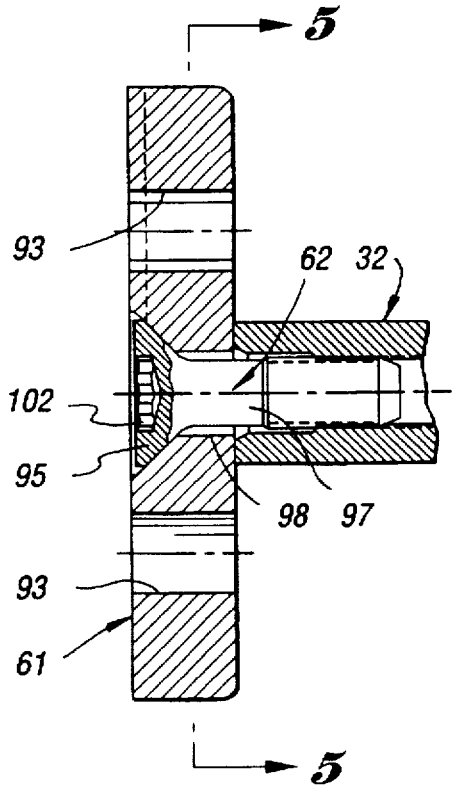
FIG. 6 is a view similar to FIG. 3 showing the armature and fuel control valve securement as taken along the line 6—6 of FIG. 5.

In FIGS. 5 and 6 is shown a second embodiment of the present invention. A standard screw 62 as shown in FIG. 2 is used, and it is sized relative to the armature plate, in the same manner as described above in connection with FIG. 2. However, the armature plate is provided with enlarged fuel equalization ports 104*b*, extending these to approximately 2 mm in diameter, and in providing a channel 106 extending from one side edge of the armature plate, across the armature plate, to near the other side edge of the armature plate, as shown in dotted line, and being axially aligned with the fuel equalization ports 104*b*, and a similar channel 108, of equal depth, width and cross-section extending between the diametrically opposed pair of equalization ports 93. As shown, only the channel 106 extends completely across the armature to an outer edge of the armature. Alternatively, any end of the channels could be extended to the outer edge of the armature, or all could be so extended, or none extended beyond the ports 93, 104*b*. However, it is preferred that at least one channel be provided extending from the socketed screw head 95 to at least one equalization port, and preferably at least one diametrically opposed pair of ports 93 or 104*b*. The channels 106, 108 are preferably rectangular in shape with arcross-section of 2.7 mm in width and 1 mm in depth and centrally located across its width relative to the respective fuel equalization ports 93, 104*b*. As a further alternative, the fuel channels could be semi-circular in cross-section, or any other shape promoting good fuel flow across and through the plate.

Figure 7:
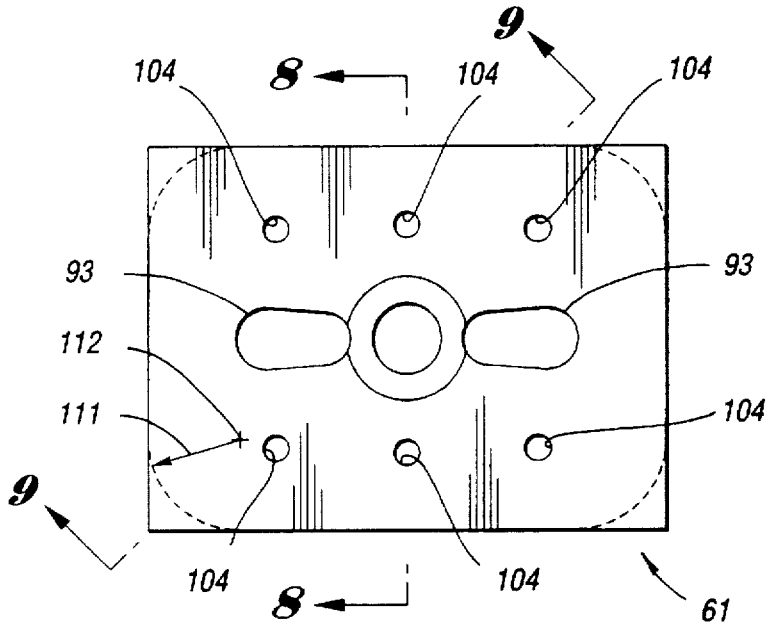
FIG. 7 is a plan view of an armature plate in accordance with another embodiment of the present invention, the view being similar to FIG. 3 but showing only the armature plate.
Figure 8:
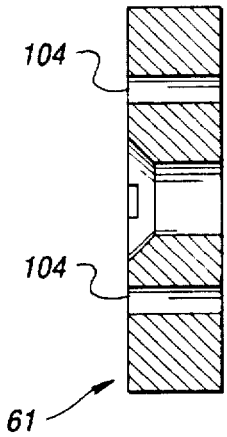
FIG. 8 is a cross-sectional view of the armature taken along the line 8—8 of FIG. 7.
Figure 9:
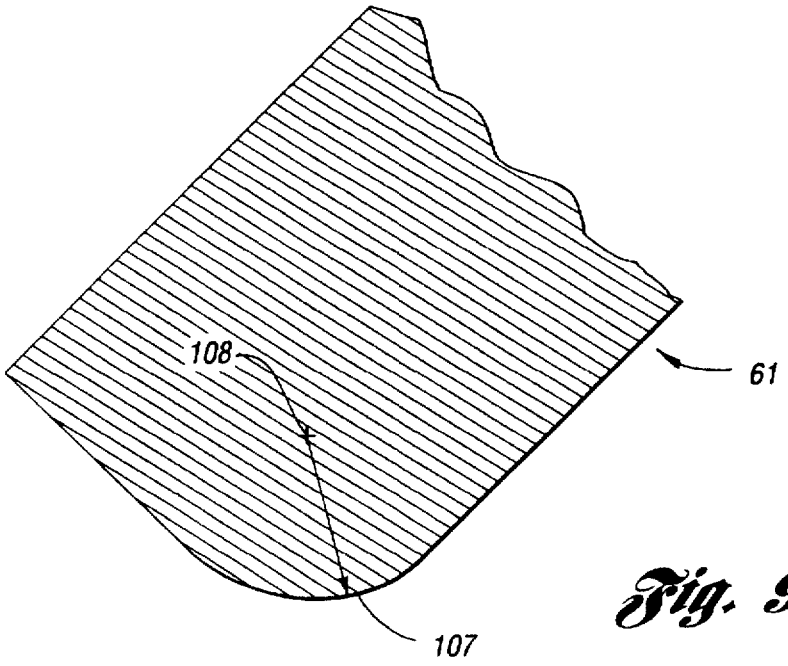
FIG. 9 is a partial view shown in cross-section taken along line 9—9 of FIG. 7 showing the manner in which the corners of the armature are radiused on the underside surface.

FIGS. 7–9 show a third embodiment of the present invention. Only the armature 61 is shown. In all other respects, i.e. the fastener 62 and control valve 32, as shown in FIGS. 3 and 4, remain the same. As shown, the equalization ports 93 are constructed in the shape of a "tear drop." The major diameter of each tear drop shaped flow passage 93 remains the same dimensionally and location wise as that shown in FIG. 3. However, the flow through passage 93 is extended towards the center of the armature plate and includes a minor diameter of 2.50 mm, with a distance of about 2.4 mm between the center lines of the major and minor diameters. Consequently, the flow through area presented by each passage 93 is somewhat greater than that depicted in FIG. 3 of the pressure equalization ports 93 having a diameter of approximately 3 mm, and in particular, 3.2 mm. The flow area of the teardrop shaped flow through passage 93 enhances the cavitation erosion elimination characteristics of the armature, but has been seen to have no adverse affects on the magnetic field strength across the armature, relative to the embodiment shown in FIG. 3. Additionally, as shown, the armature includes another two pairs of diametrically opposed pressure equalization ports 104 that are located off the center line of the major diameter of pressure equalization ports 93. Thus, as shown in FIG. 7, a total of six pressure equalization ports 104 are provided, each having a diameter of 1 mm. Alternatively, these two additional pairs of ports 104 could be eliminated so that the armature structure is more similar to that of FIG. 3.

From FIG. 9 it will be noted the underside 107 of the armature is provided at each corner with a generous radius, measuring approximately 1.5 mm taken from centerline 108, as described along an arc having a radius 111 of approximately 8 mm as measured from a common centerline 112 for each corner.

Figure 10:
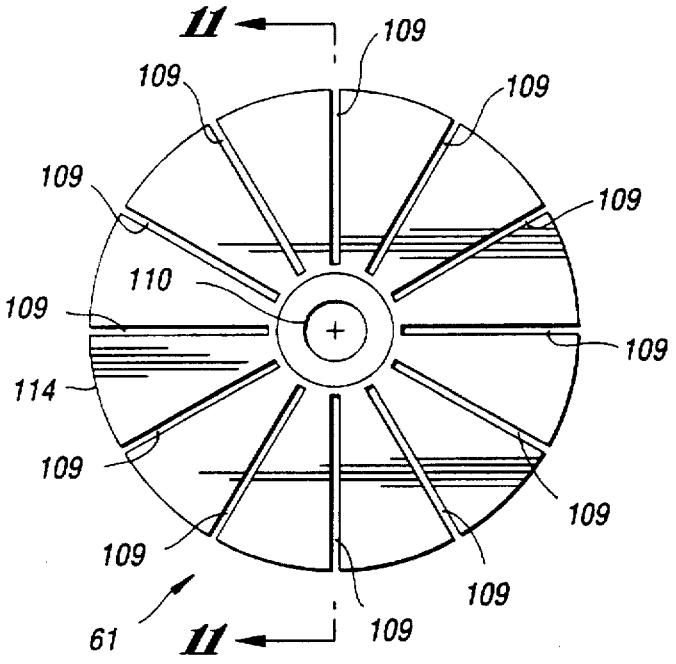
FIG. 10 is a plan view of an armature plate in accordance with a further embodiment of the present invention wherein the main flow through passages, previously shown as generally round holes, are replaced with radially extending slots.
Figure 11:
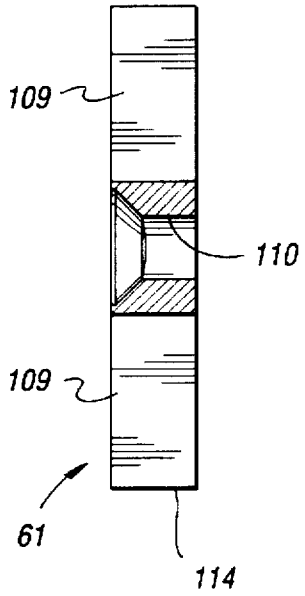
FIG. 11 is a cross-sectional view of the armature taken along the line 11—11 of FIG. 9.

In yet another embodiment of the invention, as shown in FIGS. 10 and 11, the pressure equalization ports 93 and 104 may be replaced by radially extending slots 109 which begin near the center bore 110 of the armature and extend to the edge 114 of the armature 61. These are through slots of minimal width, i.e. on the order of 0.200 mm, a taper of 1° maximum diverging toward the underside of the armature, and having a radial spacing of approximately 30°. It has been found that not only does this structure assist in the elimitation of cavitation erosion, but it also has a significantly improved effect on maintaining the strength of the magnetic field across the armature plate, and thus improving the hysteresis characteristics of the fuel control valve.

Figure 12:
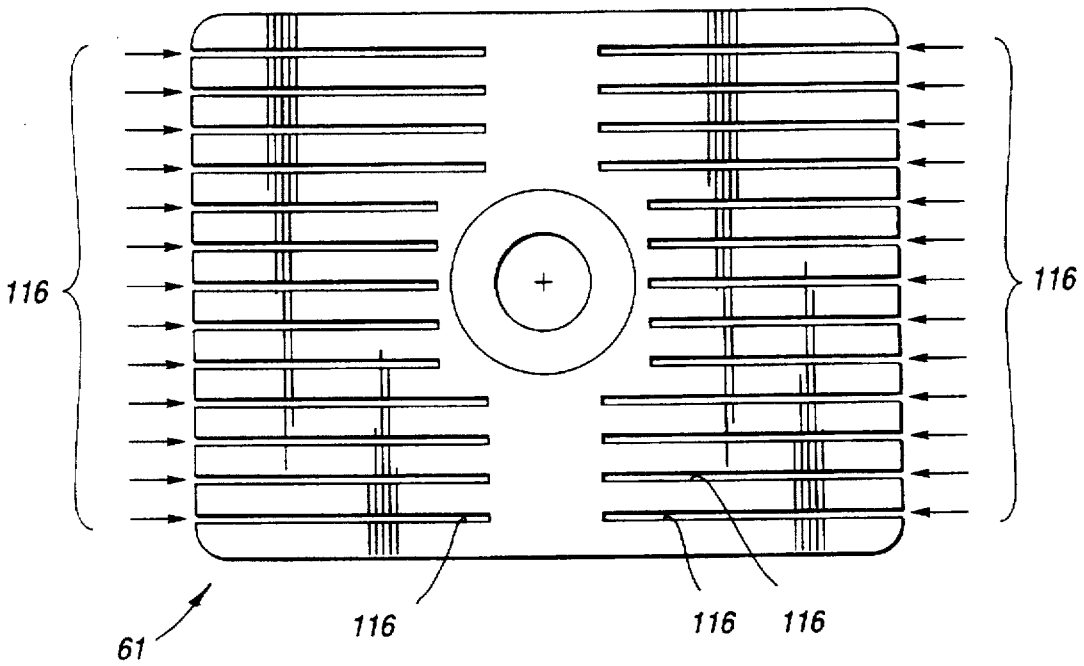
FIG. 12 is a plan view of an armature plate in accordance with yet another embodiment of the present invention wherein the radially extending slots depicted in FIG. 10 are replaced by longitudinally extending slots.

Finally, as a further embodiment of the invention, the radial extending slots 109 depicted in FIG. 11 can be replaced with longitudinally extending slots 116 as shown in FIG. 12. Other than the directional orientation of the slots 116, the structure of the armature is the same as that discussed above relative to FIGS. 10 and 11.

This armature slot configuration 112 improves performance by reducing eddy currents, which reduces energy input requirements. Additionally, armature response time is quicker due to the resultant reduction of adverse hydraulic effects and eddy currents.

In all of the additional embodiments as shown in FIGS. 7–12, it will be appreciated that the fastener 62 as depicted in FIGS. 3 and 4 may be replaced by a more conventional design, such as that shown in FIGS. 5 and 6.

While the best mode for carrying out the invention has been described in detail, those familiar with the art to which this invention relates will recognize various alternative designs and embodiments for practicing the invention as defined by the following claims.

What is claimed is:

1. An armature adapted for attachment to a control valve within an armature chamber in a device for pumping fuel to an internal combustion engine, wherein the armature comprises:

a flat plate having a top surface, the flat plate being attachable to the control valve by means of a flat headed counter-sunk screw, the head of which resides within the flat plate and the threaded shank portion of which is secured within the control valve; and said flat headed screw having a flat exposed surface substantially on the same plane as the top surface, said screw and flat plate in combination including means for precluding cavitation erosion of the screw head by fuel within the armature chamber, and wherein said screw includes an unthreaded shank portion adjacent said head, said unthreaded shank portion including anti-rotation means precluding relative rotation between the screw and the armature plate.

2. An armature as described in claim 1, wherein said anti-rotation means includes said unthreaded shank portion being non-circular in cross section and being received within said armature plate in slight clearance relation in a through-bore of substantially the same non-circular cross section.

3. An armature as described in claim 2, wherein said unthreaded shank portion of the screw is generally square in cross section.

4. An armature adapted for attachment to a control valve in an armature chamber in a device for pumping fuel to an internal combustion engine, the armature comprising:

a flat plate having a top surface, said flat plate being adapted for attachment to the control valve by means of a flat headed counter-sunk screw, the head of which resides within the flat plate and the threaded shank portion of which is adapted to be secured within the control valve;

said flat headed screw having a flat exposed surface substantially on the same plane as said top surface of said flat plate, said screw and said armature plate in combination including means for precluding cavitation erosion of the screw head by the fuel within the armature chamber, wherein said flat plate includes at least one fuel pressure equalization port whereby as the armature is cycled a portion of the fuel within the armature cavity may flow through said port; and said armature including a fuel flow channel extending across the top surface of the flat plate from at least one edge thereof to said at least one fuel pressure equalization port, whereby fuel flow through the flat plate is facilitated.

5. An armature adapted for attachment to a control valve in an armature chamber in a device for pumping fuel to an internal combustion engine, the armature comprising:

a flat plate having a top surface, the flat plate being attachable to the control valve by means of a flat headed counter-sunk screw, the head of which resides within the flat plate and the threaded shank portion of which is adapted for attachment within the control valve;

said flat headed screw having a flat exposed surface substantially on the same plane as said top surface of the flat plate, said screw and said armature plate in combination including means for precluding cavitation erosion of the screw head by the fuel within the armature chamber, wherein the flat plate includes at least one fuel pressure equalization port whereby as the armature is cycled a portion of the fuel within the armature cavity may flow through the port;

said flat plate including a fuel flow channel of generally rectangular cross section extending across the top surface of the flat plate from at least one edge thereof to said at least one fuel pressure equalization port, whereby fuel flow through the armature is facilitated.

6. An armature as described in claim 5, wherein the flat plate includes two pairs of said fuel equalization ports, each port of said pair of ports being of equal diameter and being diametrically opposed from the other and equally spaced about the center of the said flat plate from the other, at least one of said pair of ports being interconnected by said fuel flow channel, and said channel being at least as wide as the diameter of said at least one pair of ports.

7. An armature as described in claim 6, wherein the depth of said channel is no more than about one quarter the thickness of the flat plate.

8. An armature as described in claim 7, wherein the depth of said channel is about one quarter the thickness of the flat plate.

9. An armature adapted for attachment to a control valve in an armature chamber of a device for pumping fuel to an internal combustion engine, the armature comprising:

a flat plate adapted for attachment to the control valve by means of flat headed counter-sunk screw, and including means for precluding cavitation erosion of the screw head by the fuel within the armature chamber, said means for precluding cavitation erosion being positioned closely adjacent the screw; and wherein said means for precluding cavitation erosion comprises a plurality of through holes formed in the armature closely adjacent the screw in a manner to collectively provide a fuel flow passage sufficient to substantially reduce cavitation erosion, and yet of a size and geometry which will not adversely affect electromagnetic cycling of the armature, and wherein the through holes are constructed as narrow slots extending at least partially across the armature plate.

10. The armature of claim 9, wherein the flat plate forms a screw counter-bore and has outer edges, and said slots extend radially from adjacent the counter-bore to the outer edges.

11. The armature of claim 9, wherein the flat plate forms a screw counter-bore and has outer edges, and said slots extend longitudinally from adjacent the counter-bore to the outer edges.

12. An armature adapted for attachment to a control valve in an armature chamber in a device for pumping fuel to an internal combustion engine, the armature comprising:

a flat plate adapted for attachment to the control valve by means of a flat headed counter-sunk screw, and including means for precluding cavitation erosion of the screw head by the fuel within the armature chamber, said means for precluding cavitation erosion being positioned closely adjacent the screw, wherein the armature forms a screw counter-bore and the through holes are constructed as tear drop shaped holes formed in the flat plate closely adjacent the screw.

13. A device as described in claim 1 wherein said screw includes an unthreaded shank portion adjacent said head, said unthreaded shank portion including antirotation means precluding relative rotation between the screw and the armature plate.

* * * * *